US008333290B2

(12) United States Patent
Kuwahara et al.

(10) Patent No.: US 8,333,290 B2
(45) Date of Patent: Dec. 18, 2012

(54) VARIABLE DISCHARGE CAP FOR A BOTTLE-LIKE CONTAINER BODY

(75) Inventors: Katsuhito Kuwahara, Tokyo (JP); Yoshiyuki Kakuta, Tokyo (JP); Natsuo Shinozaki, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 189 days.

(21) Appl. No.: 12/451,521

(22) PCT Filed: Aug. 26, 2008

(86) PCT No.: PCT/JP2008/065178

§ 371 (c)(1),
(2), (4) Date: Nov. 17, 2009

(87) PCT Pub. No.: WO2009/028491

PCT Pub. Date: Mar. 5, 2009

(65) Prior Publication Data

US 2010/0102022 A1 Apr. 29, 2010

(30) Foreign Application Priority Data

Aug. 31, 2007 (JP) ..... 2007-227095

(51) Int. Cl.

| | |
|---|---|
| ***B65D 41/00*** | (2006.01) |
| ***B65D 51/18*** | (2006.01) |
| ***B65D 43/18*** | (2006.01) |
| *B65D 47/08* | (2006.01) |

(52) U.S. Cl. ..... 215/235; 220/255; 220/256.1; 220/259.1; 220/259.2; 220/839; 222/256; 222/562; 222/563; 222/566

(58) Field of Classification Search ..... 215/235; 220/259.1, 259.2, 259.3, 255, 256.1, 839, 220/832; 222/545, 546, 566, 562, 563, 556
See application file for complete search history.

(56) References Cited

U.S. PATENT DOCUMENTS 4,244,495 A * 1/1981 Lorscheid et al. ..... 222/153.14

(Continued)

FOREIGN PATENT DOCUMENTS

CA A-1057706 7/1979

(Continued)

OTHER PUBLICATIONS

Chinese Office Action dated Nov. 1, 2010 in corresponding Chinese Patent Application No. 200880020827.1 (with translation).

(Continued)

*Primary Examiner* — Robin Hylton
(74) *Attorney, Agent, or Firm* — Oliff & Berridge, PLC

(57) ABSTRACT

A discharge cap for discharging a content liquid from a container body includes a cylinder assembly that can be tightly fitted to a mouth portion of the container body. The cylinder assembly includes a cap main body provided with a main discharge cylinder, a discharge cylinder body provided with an auxiliary discharge cylinder that is smaller in diameter than the main discharge cylinder, and a lid body for opening or closing the auxiliary discharge cylinder. Hinge-connections are provided between the cap main body and the discharge cylinder body, and between the discharge cylinder body and the lid body, for allowing a selective opening of the main discharge cylinder and the auxiliary discharge cylinder, thereby readily changing the discharge amount or discharge mode of the content liquid.

15 Claims, 11 Drawing Sheets

U.S. PATENT DOCUMENTS

| | | | | |
|---|---|---|---|---|
| 4,717,050 | A | 1/1988 | Wright | |
| 5,497,906 | A | 3/1996 | Dubach | |
| 5,662,245 | A * | 9/1997 | Grant | 222/153.07 |
| 2005/0145655 | A1 | 7/2005 | Giblin et al. | |

FOREIGN PATENT DOCUMENTS

| | | | |
|---|---|---|---|
| FR | 2 598 686 | A1 | 11/1987 |
| JP | A-62-271854 | | 11/1987 |
| JP | U-3-72656 | | 7/1991 |
| JP | A-2001-163346 | | 6/2001 |
| JP | A-2004-256151 | | 9/2004 |
| JP | A-2005-14968 | | 1/2005 |
| JP | A-2005-306473 | | 11/2005 |
| JP | A-2008-222277 | | 9/2008 |
| WO | WO 2008/046782 | A1 | 4/2008 |

OTHER PUBLICATIONS

Extended Supplementary Search Report issued in European Patent Application No. 08792724.0 dated Dec. 1, 2010.

International Search Report issued in International Application No. PCT/JP2008/065178; Mailed Nov. 25, 2008.

May 15, 2012 Office Action issued in Korean Patent Application No. 10-2012-7008719 (with translation).

Sep. 1, 2011 Office Action issued in Korean Patent Application No. 10-2009-7025230 (with translation).

Dec. 20, 2011 Office Action issued in Japanese Patent Application No. 2007-227095 (with translation).

* cited by examiner

VARIABLE DISCHARGE CAP FOR A BOTTLE-LIKE CONTAINER BODY

TECHNICAL FIELD

The present invention relates to a discharge cap of a hinge-cap structure, which serves to open or close a bottle-like container body and is capable of readily changing or varying the discharge amount of the content within the container body.

BACKGROUND ART

There is know a discharge cap of a hinge-cap structure, which is attached to a mouth portion of a bottle-like container body for containing a content liquid, for example syrup or seasoning liquid such as soy sauce or Worcester sauce. For example, Japanese Patent Application Laid-open Publication No. 2005-014968 discloses a discharge cap, wherein a plurality of parts each having an discharge outlet with a different diameter can be combined together in order to allow the discharge amount of the content liquid to be changed or varied.

The prior art as described above is typically in the form of a snap cap which includes a cap main body having a top surface which, in turn, is formed with an opening for inserting a discharge port of an inner plug. The cap main body can be secured to a mouth portion of the container body with the inner plug secured in place. A lid body is hinge-connected to the cap main body in a pivotable manner, and has a back surface provided with a plug body that can be fitted to the above-mentioned discharge port. In this instance, the plug body is comprised of a plurality of cylindrical projections which are arranged concentrically. One of the cylindrical projections is fitted in a discharge port of a different inner plug with a different inner diameter, so as to achieve the closure. In other words, a snap cap with a cap body is formed by providing a plurality of inner plugs each having a discharge port of a different bore diameter, and a lid body separate from the inner plugs and having a plurality of integral projections of cylindrical shape corresponding to, and adapted to be tightly fitted in, the discharge port of the relevant inner plug, so as to change the inner plug with respect to the container and thereby change the discharging degree of the content liquid.

In the above-mentioned prior art, however, in order to change the discharging degree of the content liquid, it is necessary to replace the inner plug with respect to the container, after removing the snap cap from the container. Thus, there has been a problem that it is very troublesome to change the discharging degree of the content liquid while the content liquid is being discharged. For example, in the case of hot cake or the like, if it is desired, not only to simply discharge and apply a content liquid such as syrup, but also to write characters or draw figures or patterns by the discharged content liquid, it would be desirable to change the discharge port to a smaller one. However, such a demand is hardly satisfied by the above-mentioned prior art, due to the requirement for replacement of the inner plug. There is a further problem that, in order to change the discharging degree of the content liquid, it is necessary for the inner plugs to be available at hand, separately from the inner plug already secured to the container, thereby making the storage and handling much troublesome.

DISCLOSURE OF THE INVENTION

The present invention has been achieved in order to eliminate the above-mentioned problems of the prior art, and it is an object of the invention to integrally provide discharge cylinders having different bore diameters, so as to allow the discharging degree of the content liquid to be changed easily, thereby obtaining a preferred discharging mode of the content liquid.

The discharge cap according to the present invention comprises a cylinder assembly including a cap main body to be tightly secured to a mouth portion of a container body, and provided with a main discharge cylinder, a discharge cylinder body which can be tightly fitted into the main discharge cylinder of the cap main body, and which is provided with an auxiliary discharge cylinder of the discharge cylinder body, the auxiliary discharge cylinder being smaller in diameter than the main discharge cylinder; and a lid body for opening or closing the auxiliary discharge cylinder of the discharge cylinder body. According to the present invention, furthermore, the discharge cylinder body and the cap main body are hinge-connected to each other, and the lid body and the discharge cylinder body are hinge-connected to each other.

In the discharge cap according to the present invention, the hinge connection between the discharge cylinder body and the cap main body is to allow a tight fitting of the tight-fitting cylinder piece of the discharge cylinder body into the main discharge cylinder of the cap body. On the other hand, the hinge connection between the lid body and the discharge cylinder body is to allow opening or closing of the auxiliary discharge cylinder of the discharge cylinder body by means of the lid body. Thus, when the cap main body, the discharge cylinder body and the lid body are in an assembled state, the discharge cap as a whole assumes a closed state. When the lid body in the closed state is rotated and opened, the auxiliary discharge cylinder of the discharge cylinder body is opened as a discharge port of the discharge cap. Furthermore, when the assembly of the discharge cylinder body and the lid body is rotated and opened, the main discharge cylinder of the cap main body is opened as a discharge port of the discharge cap. In other words, by selecting either the opening rotation of the lid body alone, or the opening rotation of the assembly of the discharge cylinder body and the lid body, it is possible to effect switching of the discharge port of the discharge cap, which is to be opened, between the auxiliary discharge cylinder of a relatively small bore diameter and the main discharge cylinder of a relatively large bore diameter. In this way, the switching of the discharge port of the discharge cap to be opened can be achieved, depending upon which of the hinge connections is to be operated and opened. Also, the cap main body, the discharge cylinder body and the lid body are hinge-connected to form an integral assembly, instead of separate pieces.

According to the present invention, the switching of the discharge port to be opened is performed only by selection of the hinge-connection to be opened, and can thus be achieved simply and positively as is the case with the operation of an ordinary hinge-connection. Also, because the constituent elements such as the cap main body, the discharge cylinder body and the lid body are integrally hinge-connected to each other, as opposed to separate pieces, the discharge cap as a whole can be handled as an integral unit, thereby facilitating storage and handling of the constituent elements.

According to a preferred embodiment of the present invention, the at least one discharge cylinder body comprises a single discharge cylinder body that includes a first hinge-connection between the discharge cylinder body and the cap main body, and a second hinge-connection between the discharge cylinder body and the lid body, said first and second hinge connections being arranged on opposite sides to each other. In this instance, the switching of the discharge ports is made between a large discharge port and a small discharge port. The opening of the large discharge port is distinct from the opening of the small discharge port in that the direction of the opening rotation is opposite to each other and the height of the hinge-connection to be opened is also significantly different from each other. Therefore, the switching of the size of the discharge port to be opened can be clearly recognized and simply achieved without errors.

According to a preferred embodiment of the present invention, the tight-fitting cylinder piece has a length that is determined so that the content liquid within the tight-fitting cylinder piece has a surface tension with an intensity sufficient for preventing occurrence of a string-like trailing of the content liquid to be discharged, and for drawing the content liquid remaining in the auxiliary discharge cylinder back into inside of the container body. In this instance, in connection with the discharging operation of the content liquid from the auxiliary discharge cylinder, a satisfactory liquid-cut state can be obtained, besides that the content liquid remaining in the auxiliary discharge cylinder can be rapidly drawn back into inside of the container body. Thus, it is possible to avoid contamination due to the trailing of the content liquid or clag of the content liquid to the inside of the auxiliary discharge cylinder, thereby achieving a clean and satisfactory use state.

According to a preferred embodiment of the present invention, the discharge cap further comprises a cylindrical suspension mouthpiece, wherein the suspension mouthpiece is suspended from the main discharge cylinder in communication with each other and has a length that is determined so that the content liquid within the suspension mouthpiece has a surface tension with an intensity sufficient for preventing occurrence of a string-like trailing of the content liquid to be discharged, and for drawing the content liquid remaining in the main discharge cylinder back into inside of the container body. In this instance also, in connection with the discharging operation of the content liquid from the auxiliary discharge cylinder, a satisfactory liquid-cut state can be obtained, besides that the content liquid remaining in the auxiliary discharge cylinder can be rapidly drawn back into inside of the container body. Thus, it is possible to avoid contamination due to the trailing of the content liquid or clag of the content liquid to the inside of the auxiliary discharge cylinder, thereby achieving a clean and satisfactory use state.

According to a preferred embodiment of the present invention, the tight-fitting cylinder piece has an outer diameter that is equal to, or slightly smaller than an inner diameter of the suspension mouthpiece, and said tight-fitting cylinder piece has a length that is determined so that, in an assembled state of the cap main body and the discharge cylinder body, the tight-fitting cylinder piece is prevented from projecting downwards from an inside of the suspension mouthpiece. In this instance, in a state wherein the cap main body is assembled with the discharge cylinder body, the outer peripheral surface of the tight-fitting cylinder piece within the suspension mouthpiece is covered by the suspension mouthpiece substantially without clearance, so that the content liquid does not attach to the outer peripheral surface of the tight-fitting cylinder piece, even if the container body is placed upside down. Therefore, upon opening the discharge cylinder body, it is possible to avoid a disadvantageous situation wherein the content liquid attached to the tight-fitting cylinder piece is scattered due to the momentum of the tight-fitting cylinder piece as it is removed from the main discharge cylinder, thereby providing a satisfactory use state.

According to a preferred embodiment of the present invention, when the outer diameter of the tight-fitting cylinder piece is equal to, or slightly smaller than the inner diameter of the suspension mouthpiece, the tight-fitting cylinder piece has a length that is determined so that, in an assembled state of the cap main body and the discharge cylinder body, a lower end of the suspension mouthpiece is situated at a position below a lower end of the tight-fitting cylinder piece. In this instance, due to the optimized length of the tight-fitting cylinder piece, most of the content liquid, which would flow down in attachment to the suspension mouthpiece and the tight-fitting cylinder piece, is attached to the suspension mouthpiece, without being attached to the tight-fitting cylinder piece. Therefore, it is possible sufficiently to suppress the scattering of the content liquid by the tight-fitting cylinder piece, upon the opening operation.

According to a preferred embodiment of the present invention, the tight-fitting cylinder piece has a lower portion with a front region, which is formed with an opening in the form of a recess. In this instance, it is possible to prevent the tight-fitting cylinder piece from being trapped by the inner peripheral edge of the main discharge cylinder, as the tight-fitting cylinder piece is engaged with, or disengaged from the main discharge cylinder. Therefore, it is possible positively to assure a smooth opening and closing operation of the discharge cylinder body relative to the cap main body, thereby achieving a satisfactory handling state.

According to a preferred embodiment of the present invention, the tight-fitting cylinder piece has a lower portion with a front region, which is formed with an opening in the form of a recess. In this instance, it is possible to prevent the suspension mouthpiece from impeding the engagement or disengagement of the tight-fitting cylinder piece relative to the main discharge cylinder. Therefore, it is possible positively to assure a smooth opening and closing operation of the discharge cylinder body relative to the cap main body.

According to a preferred embodiment of the present invention, the main discharge cylinder has a rear region formed with an escapement having a reduced height. In this instance, it is possible to prevent the main discharge cylinder itself from impeding the engagement or disengagement of the tight-fitting cylinder piece relative to the main discharge cylinder. Therefore, it is possible positively to assure a stable and natural opening and closing operation of the discharge cylinder body relative to the cap main body.

According to a preferred embodiment of the present invention, a retention portion is provided between the lid body, on one hand, and the cap body and the discharge cylinder body, on the other hand, for maintaining an open posture of the lid body. In this instance, the retention portion maintains an open posture of either the lid body alone, or the assembly of the lid body and the discharge cylinder body, which are already in the open posture, so as not to impede the discharging operation of the content liquid. It is therefore possible to safely discharge the content liquid.

According to a preferred embodiment of the present invention, the hinge for connecting the cap main body and the discharge cylinder body with each other forms a main hinge having a self-posture holding force, and a retention portion is provided between the lid body and the cap body, for maintaining an open posture of the lid body. In this instance, the main hinge having a self-posture holding force maintains an open posture of the assembly of the cap body and the discharge cylinder body, which are already in the open posture, and the retention portion maintains an open posture of the lid body in its open posture, so as not to impede the discharging operation of the content liquid. It is therefore possible to assure a smooth and stable discharge safely discharge operation of the content liquid.

According to a preferred embodiment of the present invention, said at least one discharge cylinder body comprises a plurality of discharge cylinder bodies, which are designed so that the tight-fitting cylinder piece of the discharge cylinder body on an upper side can be tightly fitted into the auxiliary discharge cylinder of the discharge cylinder body on a lower side, and wherein the auxiliary discharge cylinder of the discharge cylinder body on the upper side has a bore diameter that is smaller than the auxiliary discharge cylinder of the discharge cylinder body on the lower side. In this instance, it is possible to set a plurality of sizes for the discharge ports of the discharge cap, which can be suitably selected. Therefore, it is possible to set a plurality of selectable stages for the discharge degree of the content liquid, to achieve an optimum discharge degree of the content liquid.

BRIEF DESCRIPTION OF THE DRAWINGS

The present invention will be described below in further details, with reference to some preferred embodiments shown in the accompanying drawings, in which.

REFERENCE NUMERALS

Figure 1:
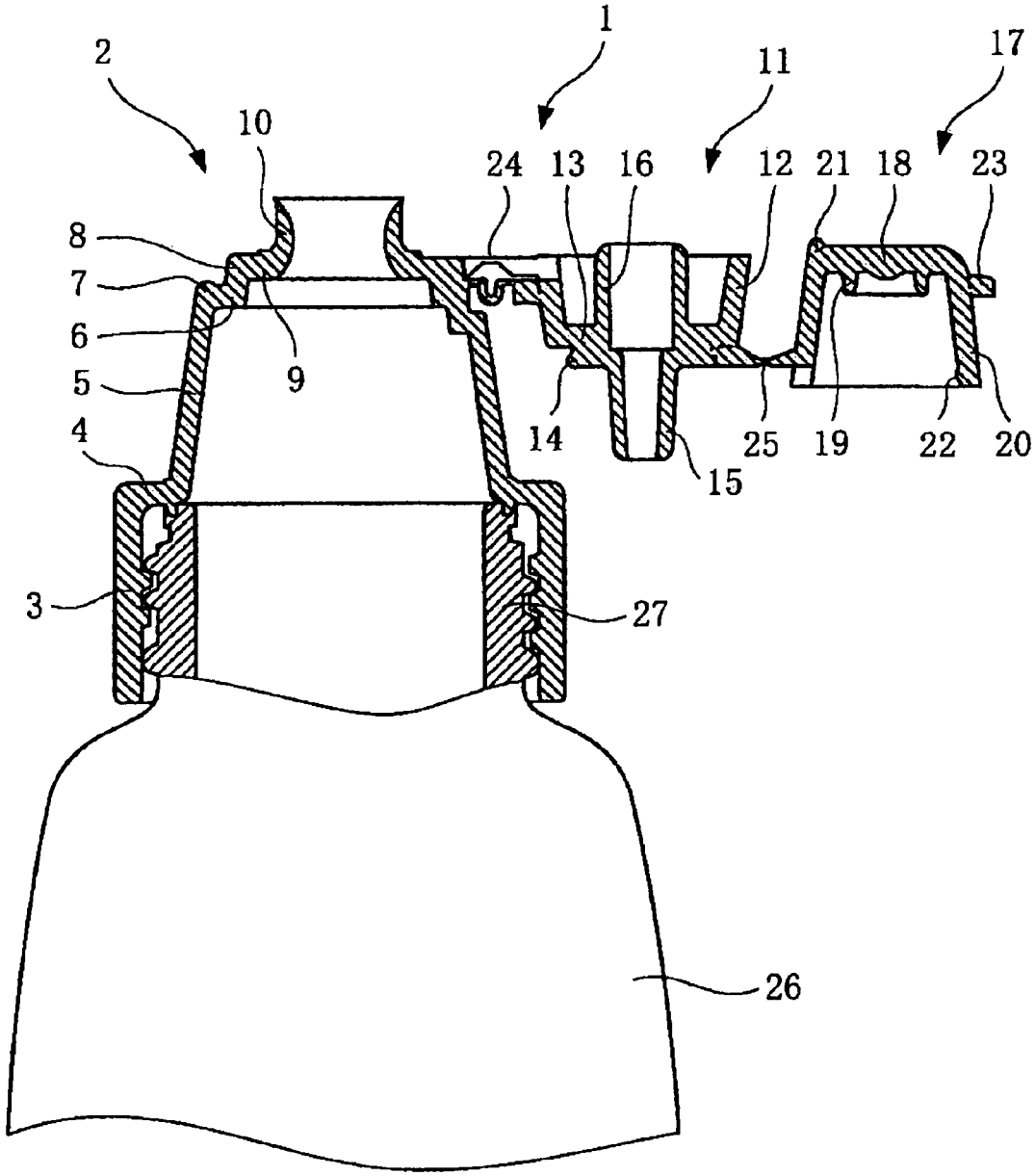
FIG. 1 is a longitudinal-sectional view of a first embodiment in its developed state.
Figure 2:
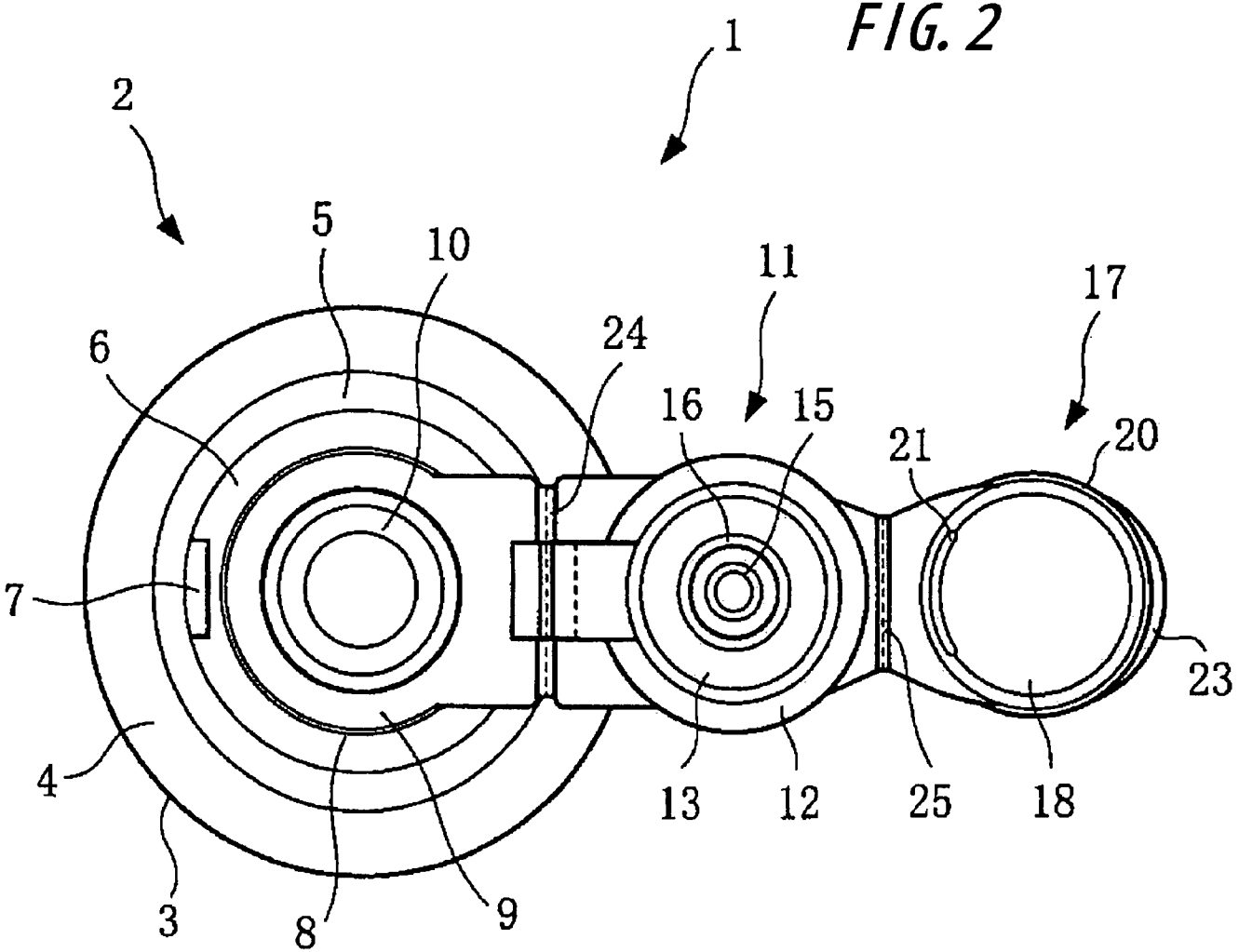
FIG. 2 is a top plan view of the first embodiment of FIG. 1 in its developed state.

1 Discharge cap
2 Cap main body
3 Cylinder assembly
4 Head plate
5 Shoulder cylinder
6 Shoulder flange
7 Engaging projection
8 Neck cylinder
9 Neck flange
10 Main discharge cylinder
10*a* Escapement
10*b* Suspension mouthpiece
10*c* Recess
11 Discharge cylinder body
12 Cylinder wall
13 Top wall
14 Engaging portion
15 Auxiliary discharge cylinder
16 Tight-fitting cylinder piece
16*a*. Recess
17 Lid body
18 Top plate
19 Sealing cylinder piece
20 Peripheral wall
21 Engaging portion
21*a* Engaging portion
22 Engaging piece
23 Finger catch
23*a* Engaging recess
24 Main hinge
25 Auxiliary hinge
26 Container body
27 Mouth portion

BEST MODE FOR CARRYING OUT THE INVENTION

First Embodiment

FIGS. 1 to 5 illustrate a discharge cap 1 according to a first embodiment of the present invention, which includes a cap main body 2, a discharge cylinder body 11 and a lid body 17. The cap main body 2 and the discharge cylinder body 11 are connected to each other by a main hinge 24 having a self-posture retaining force. The discharge cylinder body 11 and the lid body 17 are connected to each other by an auxiliary hinge 25 of an ordinary hinge structure. The discharge cap 1 as a whole is integrally molded from polypropylene resin or the like.

The cap main body 2 includes a cylinder assembly 3 that can be threadedly secured, in liquid-tight manner, to a mouth portion 27 of a bottle-shaped container body 26 from an external side. The cylinder assembly 3 has an upper end provided, via an inner collar-like head plate 4, with an upwardly projecting shoulder cylinder 5 in the form of a frustoconical cylinder with a diameter that decreases upwards. The shoulder cylinder 5 has an upper end provided, via an inner collar-like shoulder flange 6, with an upwardly projecting neck cylinder 8. Furthermore, the neck cylinder 8 has an upper end provided, via an inner collar-like neck flange 9, with an upwardly projecting main discharge cylinder 10 having an opening that is enlarged like a trumpet. The head plate 4 of the cap main body 2 has a lower surface opposite to an upper end surface of the mouth portion 27 of the container body 26, which lower surface is provided with a circumferential seal projection. The shoulder flange 6 has an upper surface with a front end region, which is provided with an engaging projection 7 having a low projection height.

The discharge cylinder body 11 includes a cylinder wall 12 in the form of a frustoconical cylinder with a diameter that decreases upwards. The cylinder wall 12 has an upper end provided with a top wall 13. The top wall 13 has an upper surface with a center region, which is provided with an upwardly projecting auxiliary discharge cylinder 15 in the form of an elongated cylinder piece that is smaller in bore diameter than the main discharge cylinder 10. The top plate 13 also has a lower surface provided with a downwardly projecting tight-fitting cylinder piece 16, which can be communicated with the auxiliary discharge cylinder 15 and fitted to the main discharge cylinder 10. The upper surface of the top plate 13 is further provided with an engaging portion 14.

Figure 4:
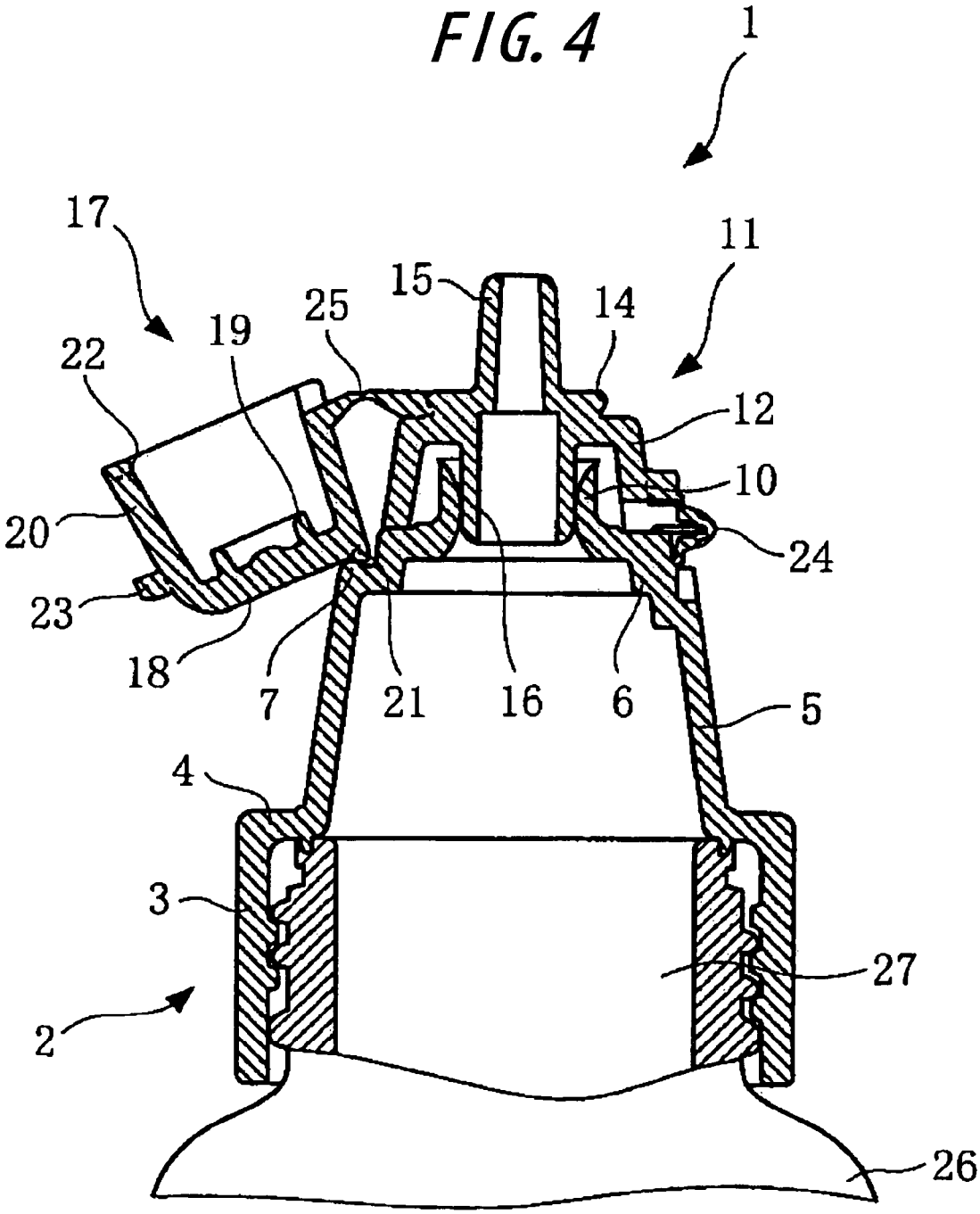
FIG. 4 is a longitudinal-sectional view of the first embodiment of FIG. 1 in its "small" closed state.

The lid body 17 includes a peripheral wall 20 in the form of a frustoconical cylinder with a diameter that decreases upwards. The peripheral wall 20 has an upper end provided with a top plate 18. The top plate 18 has a lower surface provided with a sealing cylinder piece 19, which can be tightly fitted to the auxiliary discharge cylinder 15 of the discharge cylinder body 11. The top plate 18 has an upper surface with a front end region, which is provided with an engaging portion 21 in the form of a projection piece forming a retention portion for holding an open posture of the lid body (FIG. 4). The peripheral wall 20 has an inner peripheral surface with a rear side. This rear side includes a lower end provided with an engaging piece 22 for riding over and engaging with the engaging portion 14 of the discharge cylinder body 11, and an upper end provided with a finger catch 23 to be engaged by a user's finger.

The neck cylinder 8 of the cap main body 2 on its rear side and the cylinder wall 12 of the discharge cylinder body 11 on its rear side of the lower end are connected to each other by the main hinge 24. The main hinge 24 allows the tight-fitting cylinder piece 16 of the discharge cylinder body 11 to be tightly fitted into the main discharge cylinder 10 of the cap main body 2 (FIG. 4), with the cylinder wall 12 fitted to the neck cylinder 8 from an outer side. The cap main body 2 and the discharge cylinder body 11 are held in their set posture as shown in FIGS. 3 and 4, by the fitting force of the tight-fitting cylinder piece 16 relative to the main discharge cylinder 10, and also by the closed-posture holding force of the main hinge 24 having a self-posture holding force.

Figure 5:
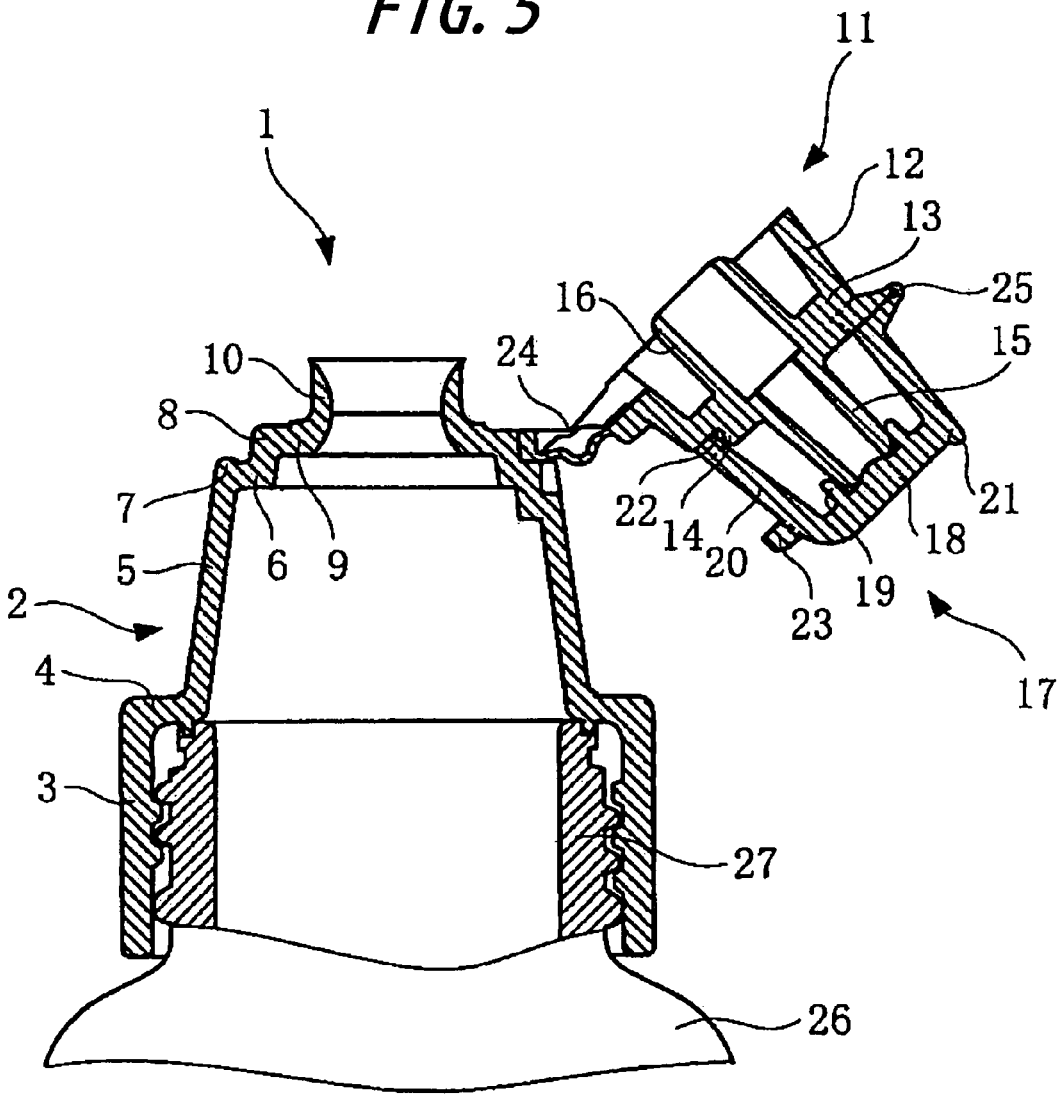
FIG. 5 is a longitudinal-sectional view of the first embodiment of FIG. 1 in its "large" closed state.
Figure 6:
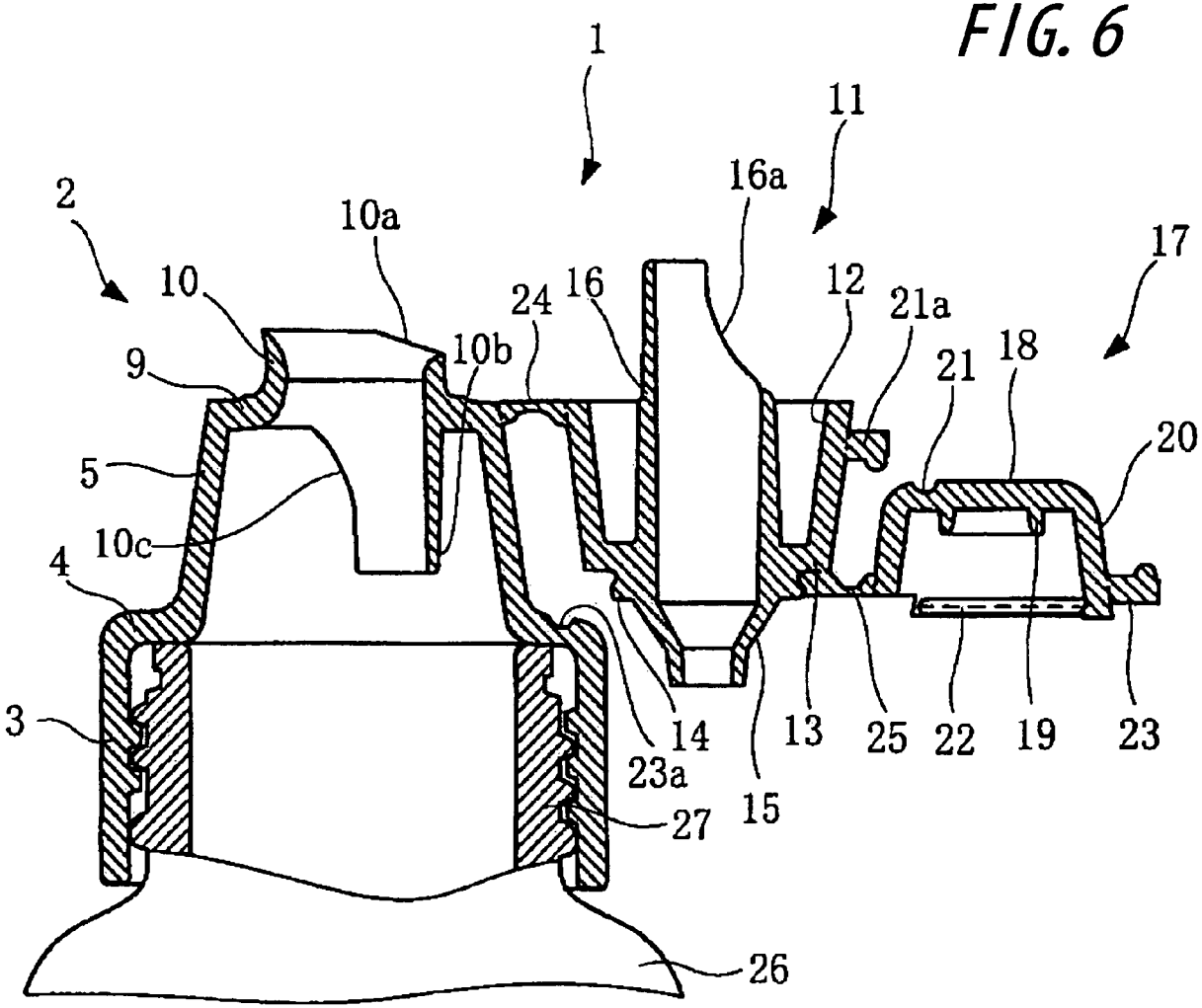
FIG. 6 is a longitudinal-sectional view of a second embodiment in its developed state.

The cylinder wall 12 of the discharge cylinder body 11 on its front side of the upper end and the peripheral wall 20 of the lid body 17 on its front side of the lower end are connected to each other by the auxiliary hinge 25. The auxiliary hinge 25 allows the sealing cylinder piece 19 of the lid body 17 to be tightly fitted to the auxiliary discharge cylinder 15 of the discharge cylinder body 11 from an outer side (FIG. 3), with the engaging piece 22 of the peripheral wall 20 ridden over, and engaged with the engaging portion 14. The discharge cylinder body 11 and the lid body 17 are held in their set posture as shown in FIGS. 3 and 5, by the fitting force of the sealing cylinder piece 19 relative to the auxiliary discharge cylinder 15, and the holding force of the engaging piece 22 relative to the engaging portion.

Figure 3:
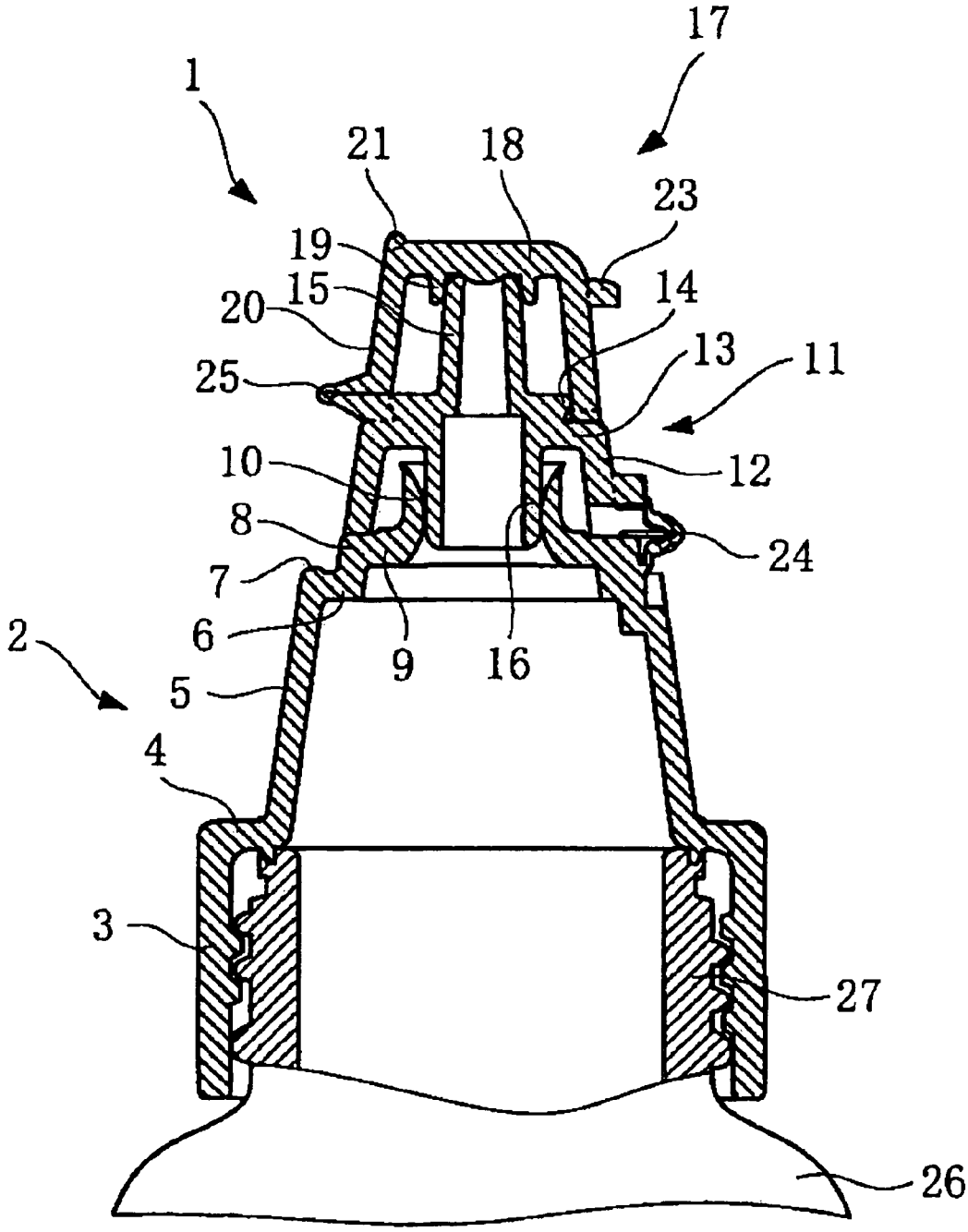
FIG. 3 is a longitudinal-sectional view of the first embodiment of FIG. 1 in its closed state.

The state as shown in FIG. 3, wherein the discharge cylinder body 11 and the lid body 17 are in their set posture, corresponds to the closed state of the discharge cap 1 and, hence, the closed state of the container body 26. In the state wherein the lid body 17 is opened (FIG. 4), the auxiliary discharge cylinder 15 of the discharge cylinder body 11 forms the discharge port of the discharge cap 1, with the result that the discharge port so formed is a small port. This open posture of the lid body 17 is held by the retention portion between the cap main body 2 and the lid body 17, i.e., by the riding-over engagement of the engaging portion 21 relative to the engaging projection 7 (FIG. 4). In the state wherein the discharge cylinder body 11 is opened (FIG. 5), the main discharge cylinder 10 of the cap main body 2 forms the discharge port of the discharge cap 1, with the result that the discharge port so formed is a large port. This open posture of the discharge cylinder body 11 is held by the self-posture holding force exerted by the main hinge 24 (FIG. 5). By holding the lid body 17 in its set state when the discharge cylinder body 11 is opened, as shown in FIG. 5, the lid body 17 is prevented from causing a disadvantageous state wherein the discharging operation of the content liquid is impeded by the lid body 17.

Second Embodiment

FIGS. 6 to 8 and FIGS. 9(*a*) and 9(*b*) illustrate a discharge cap 1 according to a second embodiment of the present invention, which also includes a cap main body 2, a discharge cylinder body 11 and a lid body 17. The cap main body 2 and the discharge cylinder body 11 are connected to each other by a main hinge 24 of an ordinary hinge structure. The discharge cylinder body 11 and the lid body are connected to each other by an auxiliary hinge 25 of an ordinary hinge structure.

The cap main body 2 includes a cylinder assembly 3 that can be threadedly secured, in liquid-tight manner, to a mouth portion 27 of a bottle-shaped container body 26 from an external side. The cylinder assembly 3 has an upper end provided, via an inner collar-like head plate 4, with an upwardly projecting shoulder cylinder 5 in the form of a frustoconical cylinder with a diameter that decreases upwards. The shoulder cylinder 5 has an upper end provided, via an inner collar-like neck flange 9, with an upwardly projecting main discharge cylinder 10 having an opening that is enlarged like a trumpet, and also with a downwardly projecting suspension mouthpiece 10*b* as a downward extension of the main discharge cylinder 10.

The main discharge cylinder 10 has a rear half section, which is provided with a low escapement 10*a* formed by an oblique removal of the material. Similarly, the suspension mouthpiece 10*b* has a lower front section, which is provided with a recess 10*c* that is formed by removing a part of the cylinder wall. The head plate 4 has a rear section in its upper surface, which is provided with an engaging recess 23*a* that forms part of the engaging means.

The discharge cylinder body 11 is provided, at the center region in the upper surface of the top wall 13, with an upwardly projecting auxiliary discharge cylinder 15 in the form of an elongated cylinder piece that is smaller in bore diameter than the main discharge cylinder 10. The lower portion of the tight-fitting cylinder piece 16 has a front region, which is provided with an open recess 16*a* formed by removing a part of the cylinder wall. The outer peripheral surface of the cylinder wall 12 has a lower end portion, which is provided in its front side with an engaging portion 21*a* that forms part of the engaging means. The tight-fitting cylinder piece 16 of the discharge cylinder body 11 has an outer diameter, which is substantially same as, or slightly smaller than, the inner diameter of the suspension mouthpiece 10*b*. The tight-fitting cylinder piece 16 has a length that is determined such that the tight-fitting cylinder piece 16 does not project downwards from the inside of the suspension mouthpiece 10*b*. The outer peripheral surface of the tight-fitting cylinder piece 16 as fitted within the suspension mouthpiece 10*b* is substantially completely covered by the suspension mouthpiece 10*b*. Therefore, the content liquid is substantially completely prevented from entering into a space that would be otherwise formed between the suspension mouthpiece 10*b* and the tight-fitting cylinder piece 16, thereby preventing the content liquid from attaching to the outer peripheral surface of the tight-fitting cylinder piece 16.

Figure 9:
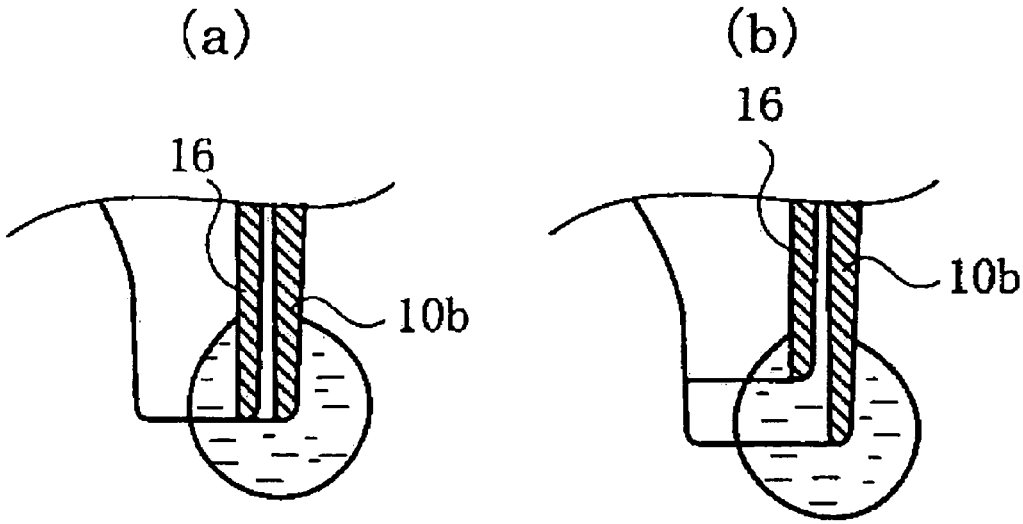
FIGS. 9(*a*) and 9(*b*) are explanatory views showing attached states of the content liquid.
Figure 10:
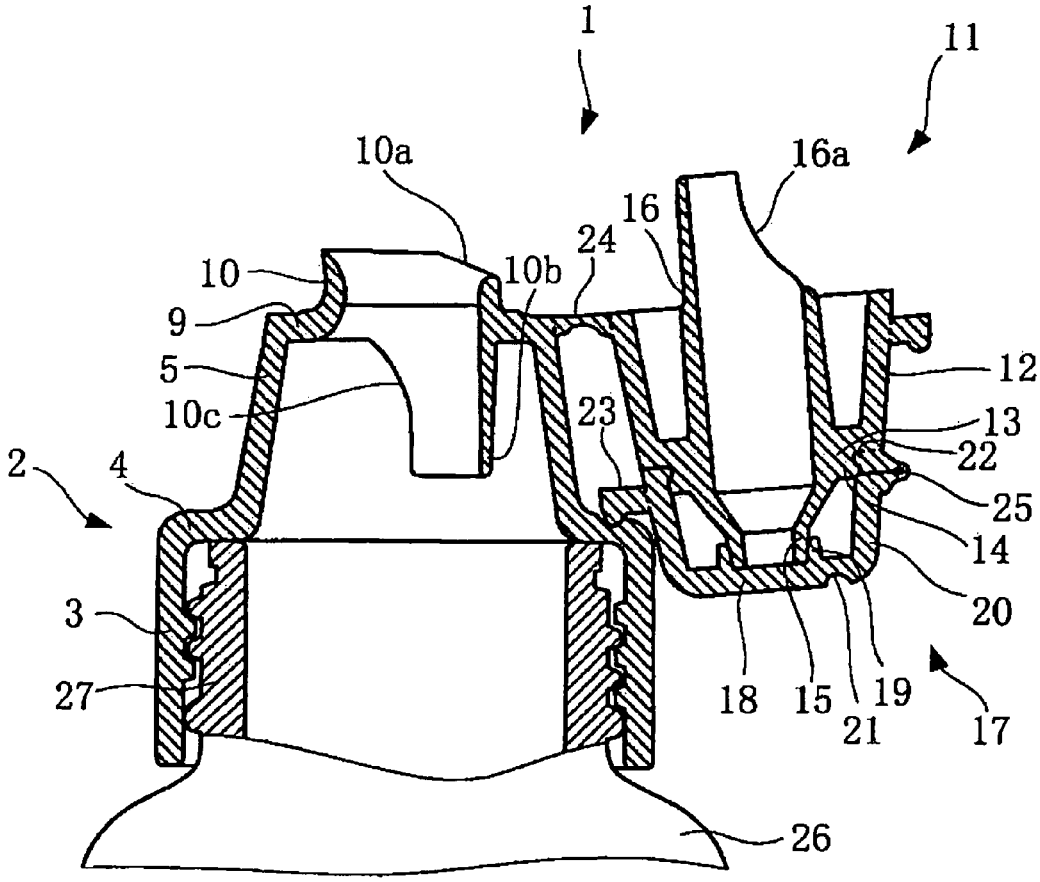
FIG. 10 is a longitudinal-sectional view of the second embodiment of FIG. 6 in its "large" closed state.

In particular, if the lower end of the tight-fitting cylinder piece 16 is situated above the lower end of the suspension mouthpiece 10*b* as shown in FIG. 9(*b*), most of the content liquid flowing downwards along the suspension mouthpiece 10*b* and the tight-fitting cylinder piece 16 is attached to the suspension mouthpiece 10*b*, as distinguished from an arrangement wherein these ends are situated at the same level as shown in FIG. 9(*a*). Therefore, upon opening the discharge cylinder body 11, as shown in FIG. 10, it is possible to avoid a disadvantageous situation wherein the content liquid attached to the tight-fitting cylinder piece is scattered due to the momentum of the tight-fitting cylinder piece 16 as it is removed from the main discharge cylinder 10.

The lid body 17 has a peripheral wall 20 and a top plate 18 on the upper end of the peripheral wall 20. The top plate 18 has a lower surface, which is provided with a sealing cylinder piece 19. The upper surface of the top plate 18 has a front end, which is provided with an engaging portion 21 in the form of a recess that forms part of the engaging means for maintaining the open posture of the lid body 17, in combination with the engaging portion 21*a* of the discharge cylinder body 11. The peripheral wall 20 is provided with an engaging piece 22 and a finger catch 23, the latter being arranged at the upper end portion on the rear side of the outer peripheral surface, so as to function also as an engaging portion forming part of the engaging means, in combination with the engaging recess 23*a* of the cap main body 2.

Figure 7:
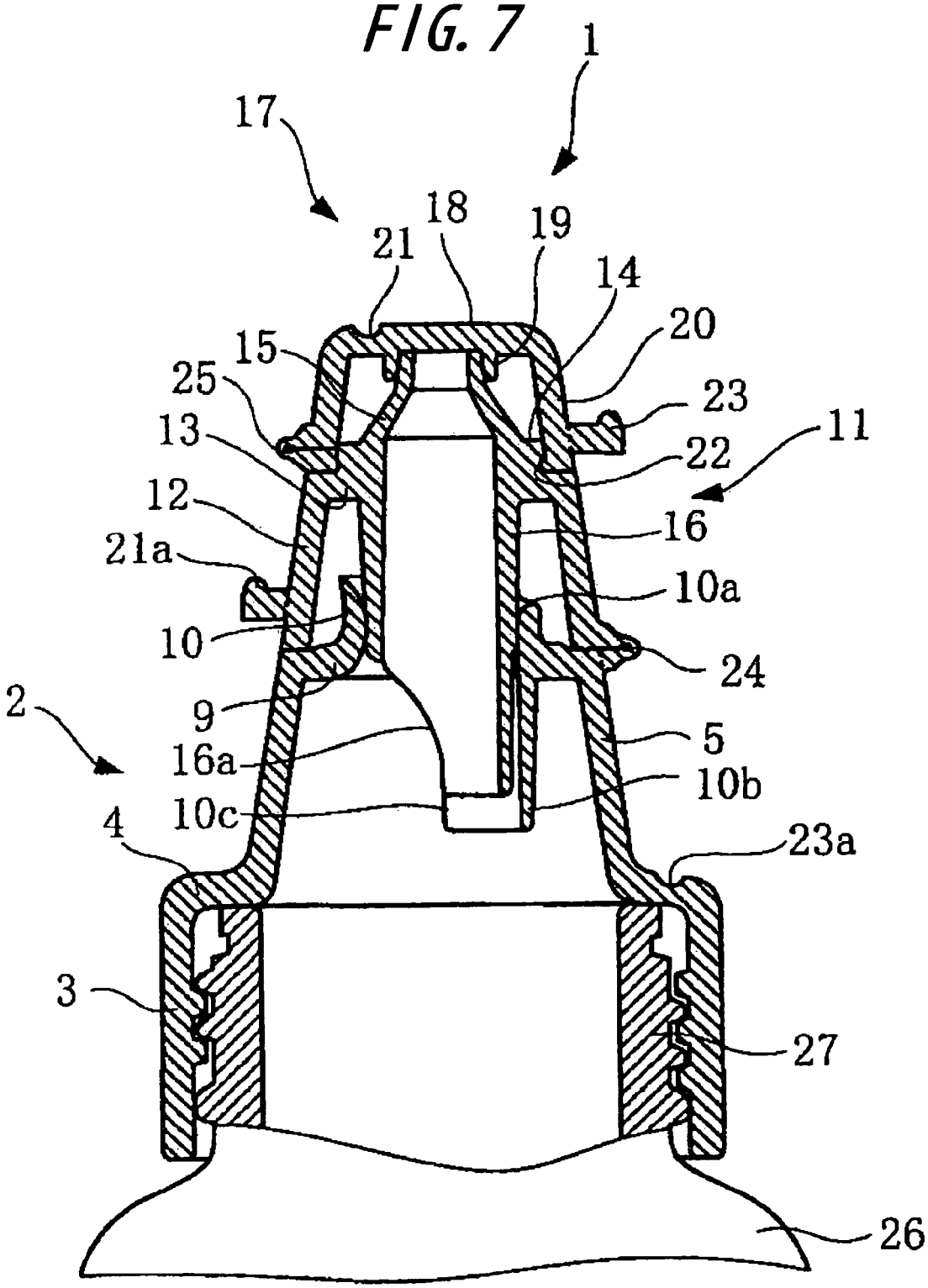
FIG. 7 is a longitudinal-sectional view of the second embodiment of FIG. 6 in its closed state.
Figure 8:
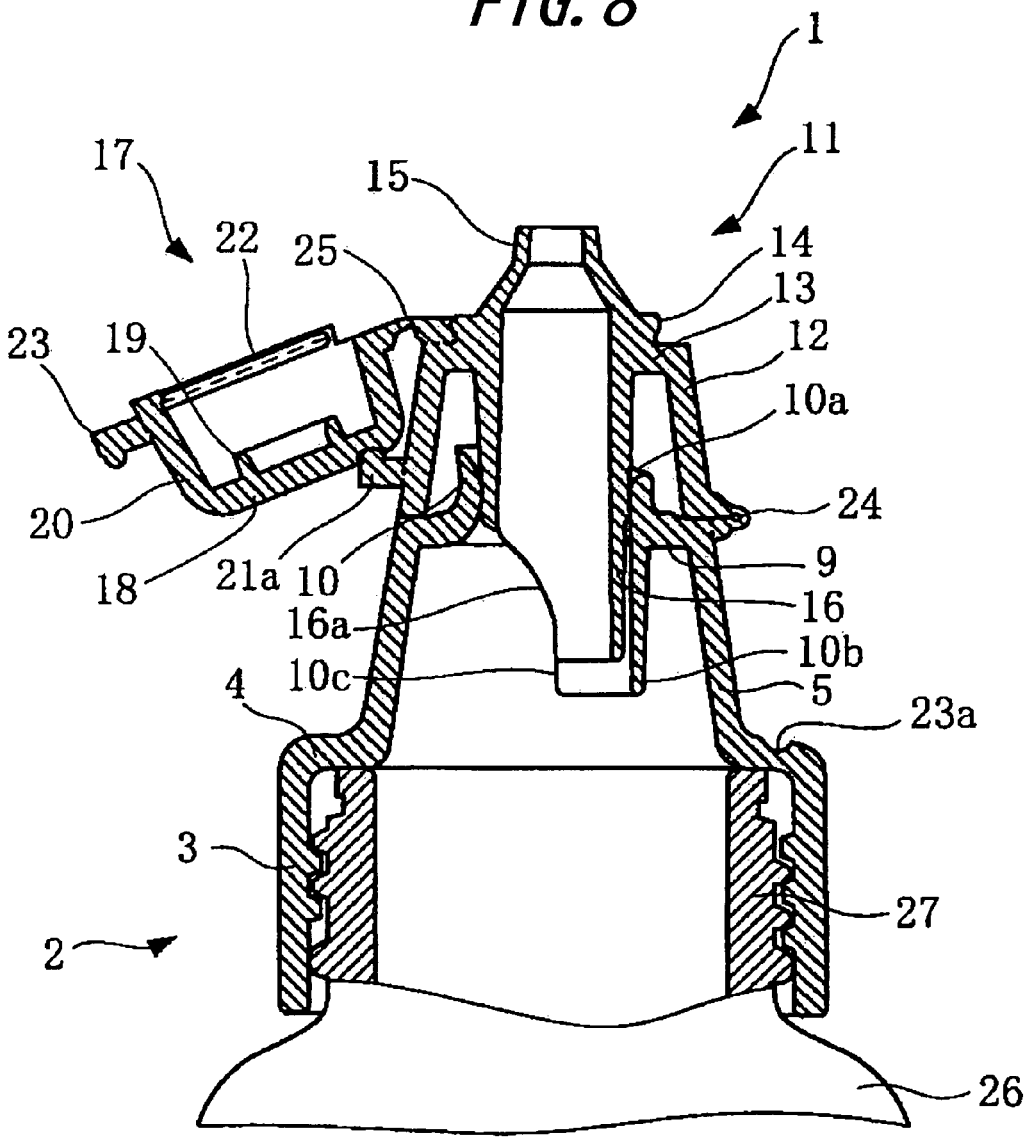
FIG. 8 is a longitudinal-sectional view of the second embodiment of FIG. 6 in its "small" closed state.

The shoulder cylinder 5 of the cap main body 2 on the rear side and the cylinder wall 12 of the discharge cylinder body 11 on the rear side at its lower end are connected to each other by a main hinge 24. The main hinge 24 allows the tight-fitting cylinder piece 16 of the discharge cylinder body 11 to be tightly fitted into the main discharge cylinder 10 of the cap main body 2 (FIG. 8). The cap main body 2 and the discharge cylinder body 11 are held in their set posture as shown in FIGS. 7 and 8, by the fitting force of the tight-fitting cylinder piece 16 relative to the main discharge cylinder 10. The cylinder wall 12 of the discharge cylinder body 11 on its front side of the upper end and the peripheral wall 20 of the lid body 17 on its front side of the lower end are connected to each other by the auxiliary hinge 25, as in the first embodiment.

The length of the suspension mouthpiece 10*b* and the length of the tight-fitting cylinder piece 16 are determined such that the content liquid within these elements has a surface tension with an intensity sufficient for preventing occurrence of a string-like trailing of the content liquid to be discharged from the main discharge cylinder 10 or the auxiliary discharge cylinder 10, and for drawing the content liquid remaining in the main discharge cylinder 10 and the auxiliary discharge cylinder 15 back into inside of the container body 26. Furthermore, as can be appreciated from FIGS. 8 and 10, the recess 10*c* formed in the suspension mouthpiece 10*b* and the recess 16*a* formed in the tight-fitting cylinder piece 16 serve to prevent the suspension mouthpiece 10*b* and the tight-fitting cylinder piece 16 from impeding discharge of the content liquid.

Third Embodiment

Figure 11:
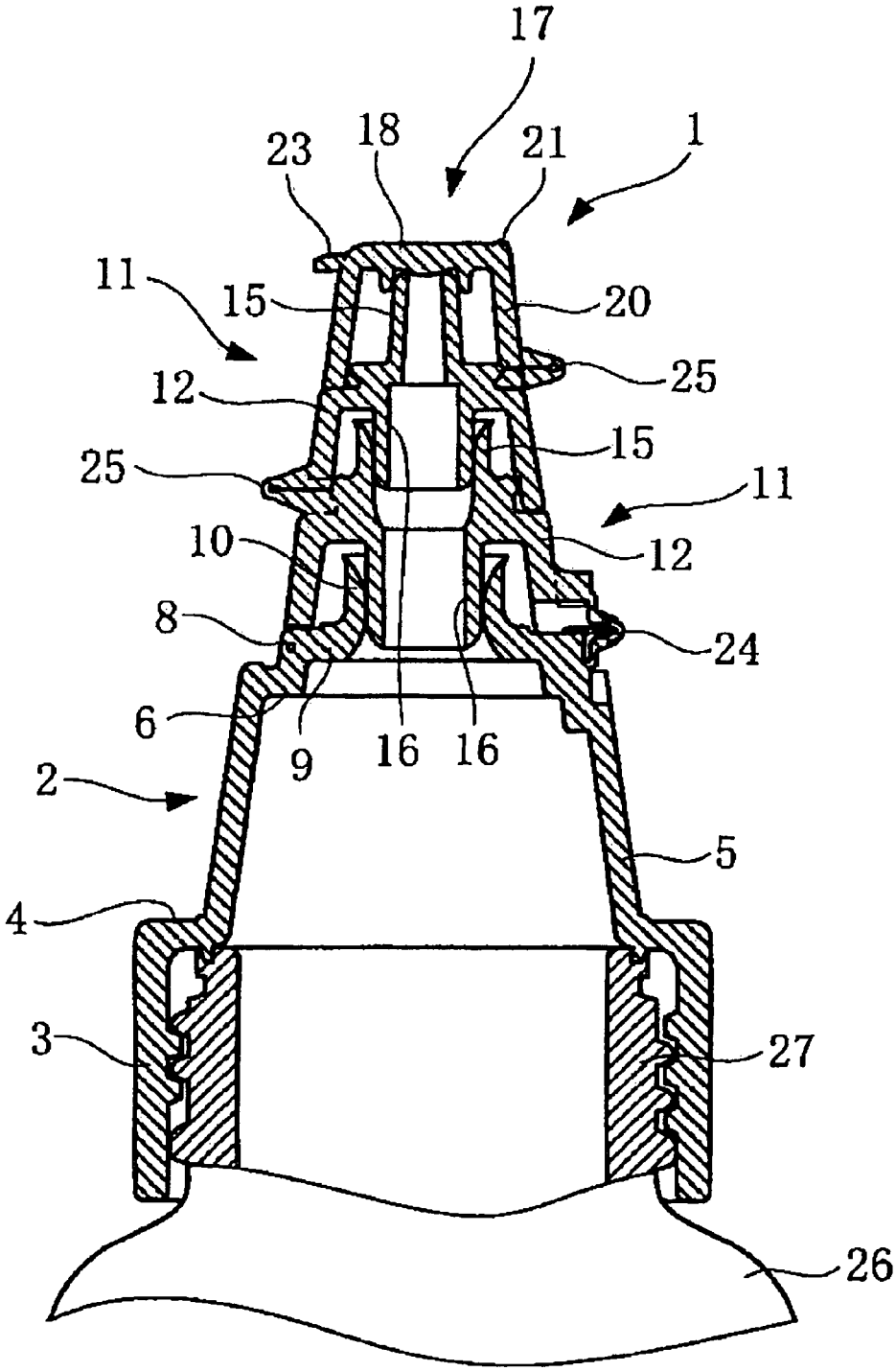
FIG. 11 is a longitudinal-sectional view of a third embodiment in its closed state.

FIG. 11 illustrates a third embodiment of the present invention, which is provided with two discharge cylinder bodies 11 so as to change the size of the discharge port of the discharge cap 1 between three stages, i.e., "large", "intermediate" and "small" stages. In the third embodiment, the tight-fitting cylinder piece 16 of the discharge cylinder bodies 11 on the upper side can be tightly fitted into the auxiliary discharge cylinder 15 of the discharge cylinder bodies 11 on the lower side. IN this instance, the discharge port of the discharge cap 1 includes a small port formed by the auxiliary discharge cylinder 15 of the discharge cylinder bodies 11 on the upper side, an intermediate port formed by the auxiliary discharge cylinder 15 of the discharge cylinder bodies 11 on the lower side, and a large port formed by the main discharge cylinder 10 of the cap main body 2.

INDUSTRIAL APPLICABILITY

As explained above, the discharge cap utilizing a hinge cap structure according to the present invention makes it possible to change the bore diameter of the discharge port by selecting the elements to be opened, and can thus be widely used in applications where it is desired to change the size of the opening in a stepwise manner.

The invention claimed is:

1. A discharge cap for discharging a content liquid from a container body, comprising a cylinder assembly to be tightly secured to a mouth portion of the container body, said cylinder assembly comprising:

a cap main body provided with a main discharge cylinder;

at least one discharge cylinder body having a top wall, said top wall being provided with a tight-fitting cylinder piece that can be tightly fitted into the main discharge cylinder, and an auxiliary discharge cylinder which is in communication with the tight-fitting cylinder piece and smaller in diameter than the main discharge cylinder; and a lid body for opening or closing the auxiliary discharge cylinder;

the discharge cylinder body being hinge-connected to the cap main body so as to allow a tight-fitting of the tight-fitting cylinder piece to the main discharge cylinder, and the lid body is hinge-connected to the discharge cylinder body so as to allow opening or closing of the auxiliary discharge cylinder;

the discharge cap further comprising a suspension mouthpiece, said suspension mouthpiece being suspended from the main discharge cylinder in communication with each other, and the tight-fitting cylinder piece having an outer diameter that is equal to, or slightly smaller than an inner diameter of the suspension mouthpiece, and further having a length that is determined so that, in an assembled state of the cap main body and the discharge cylinder body, the tight-fitting cylinder piece is prevented from projecting downwards from an inside of the suspension mouthpiece, wherein said at least one discharge cylinder body comprises a single discharge cylinder body that includes a first hinge-connection between the discharge cylinder body and the cap main body, and a second hinge-connection between the discharge cylinder body and the lid body, said first and second hinge connections being arranged on opposite sides to each other in a lateral direction, in the assembled state.

2. The discharge cap according to claim 1, wherein said tight-fitting cylinder piece has a length that is determined so that, in an assembled state of the cap main body and the discharge cylinder body, a lower end of the suspension mouthpiece is situated at a position below a lower end of the tight-fitting cylinder piece.

3. The discharge cap according to claim 1, wherein the suspension mouthpiece has a lower portion with a front region, which is formed with an opening in the form of a recess.

4. The discharge cap according to claim 1, wherein the tight-fitting cylinder piece has a lower portion with a front region, which is formed with an opening in the form of a recess.

5. The discharge cap according to claim 1, wherein the main discharge cylinder has a rear region formed with an escapement having a reduced height.

6. The discharge cap according to claim 1, wherein a retention portion is provided between the lid body, on one hand, and the cap body and the discharge cylinder body, on the other hand, for maintaining an open posture of the lid body.

7. The discharge cap according to claim 1, wherein the hinge for connecting the cap main body and the discharge cylinder body with each other forms a main hinge having a self-posture holding force, and a retention portion is provided between the lid body and the cap body, for maintaining an open posture of the lid body.

8. The discharge cap according to claim 1, wherein said at least one discharge cylinder body comprises a plurality of discharge cylinder bodies, which are designed so that the tight-fitting cylinder piece of the discharge cylinder body on an upper side can be tightly fitted into the auxiliary discharge cylinder of the discharge cylinder body on a lower side, and wherein the auxiliary discharge cylinder of the discharge cylinder body on the upper side has a bore diameter that is smaller than the auxiliary discharge cylinder of the discharge cylinder body on the lower side.

9. A discharge cap for discharging a content liquid from a container body, comprising a cylinder assembly to be tightly secured to a mouth portion of the container body, said cylinder assembly comprising:

a cap main body provided with a main discharge cylinder;

at least one discharge cylinder body having a top wall, said top wall being provided with a tight-fitting cylinder piece that can be tightly fitted into the main discharge cylinder, and an auxiliary discharge cylinder which is in communication with the tight-fitting cylinder piece and smaller in diameter than the main discharge cylinder; and a lid body for opening or closing the auxiliary discharge cylinder;

the discharge cylinder body being hinge-connected to the cap main body so as to allow a tight-fitting of the tight-fitting cylinder piece to the main discharge cylinder, and the lid body is hinge-connected to the discharge cylinder body so as to allow opening or closing of the auxiliary discharge cylinder;

the discharge cap further comprising a retention portion provided between the lid body, on one hand, and the cap body and the discharge cylinder body, on the other hand, for maintaining an open posture of the lid body, wherein said at least one discharge cylinder body comprises a single discharge cylinder body that includes a first hinge-connection between the discharge cylinder body and the cap main body, and a second hinge-connection between the discharge cylinder body and the lid body, said first and second hinge connections being arranged on opposite sides to each other in a lateral direction, in the assembled state.

10. The discharge cap according to claim 9, further comprising a suspension mouthpiece, said suspension mouthpiece being suspended from the main discharge cylinder in communication with each other, said tight-fitting cylinder piece having an outer diameter that is equal to, or slightly smaller than an inner diameter of the suspension mouthpiece, and further having a length that is determined so that, in an assembled state of the cap main body and the discharge cylinder body, the tight-fitting cylinder piece is prevented from projecting downwards from an inside of the suspension mouthpiece.

11. The discharge cap according to claim 9, wherein said tight-fitting cylinder piece has a length that is determined so that, in an assembled state of the cap main body and the discharge cylinder body, a lower end of the suspension mouthpiece is situated at a position below a lower end of the tight-fitting cylinder piece.

12. The discharge cap according to claim 9, wherein the suspension mouthpiece has a lower portion with a front region, which is formed with an opening in the form of a recess.

13. The discharge cap according to claim 9, wherein the tight-fitting cylinder piece has a lower portion with a front region, which is formed with an opening in the form of a recess.

14. The discharge cap according to claim 9, wherein the main discharge cylinder has a rear region formed with an escapement having a reduced height.

15. The discharge cap according to claim 9, wherein said at least one discharge cylinder body comprises a plurality of discharge cylinder bodies, which are designed so that the tight-fitting cylinder piece of the discharge cylinder body on an upper side can be tightly fitted into the auxiliary discharge cylinder of the discharge cylinder body on a lower side, and wherein the auxiliary discharge cylinder of the discharge cylinder body on the upper side has a bore diameter that is smaller than the auxiliary discharge cylinder of the discharge cylinder body on the lower side.

* * * * *